US012089738B2

(12) United States Patent
Larkner et al.

(10) Patent No.: US 12,089,738 B2
(45) Date of Patent: Sep. 17, 2024

(54) STORAGE DEVICE WITH DRAWER RETAINER AND STABILIZER

(71) Applicant: HELMER SCIENTIFIC, LLC, Noblesville, IN (US)

(72) Inventors: Thomas J. Larkner, Noblesville, IN (US); Bryan T. Shannon, Fishers, IN (US); Grant Balbach, Ferdinand, IN (US)

(73) Assignee: HELMER SCIENTIFIC, LLC, Noblesville, IN (US)

( * ) Notice: Subject to any disclaimer, the term of this patent is extended or adjusted under 35 U.S.C. 154(b) by 0 days.

(21) Appl. No.: 18/481,791

(22) Filed: Oct. 5, 2023

(65) Prior Publication Data

US 2024/0023708 A1 Jan. 25, 2024

Related U.S. Application Data

(60) Continuation of application No. 17/859,640, filed on Jul. 7, 2022, now Pat. No. 11,812,851, which is a division of application No. 16/967,002, filed as application No. PCT/US2019/016292 on Feb. 1, 2019, now Pat. No. 11,439,232.

(60) Provisional application No. 62/625,546, filed on Feb. 2, 2018.

(51) Int. Cl.

| | |
|---|---|
| ***A47B 88/57*** | (2017.01) |
| ***A47B 88/417*** | (2017.01) |
| ***A47B 88/43*** | (2017.01) |
| ***A47B 88/477*** | (2017.01) |

(52) U.S. Cl.

CPC ..... *A47B 88/57* (2017.01); *A47B 88/417* (2017.01); *A47B 88/43* (2017.01); *A47B 88/477* (2017.01)

(58) Field of Classification Search

CPC ..... A47B 88/57; A47B 88/417; A47B 88/43; A47B 88/477

See application file for complete search history.

(56) References Cited

U.S. PATENT DOCUMENTS

| | | | |
|---|---|---|---|
| 879,690 | A | 2/1908 | Starrett |
| 2,319,283 | A | 5/1943 | Zalkind |
| 2,337,079 | A | 12/1943 | Zalkind |
| 2,410,701 | A | 11/1946 | Zalkind |
| 2,620,252 | A | 12/1952 | Restivo |
| 2,656,238 | A | 10/1953 | Adler |
| 2,992,057 | A | 7/1961 | Maxwell |
| 3,038,774 | A | 6/1962 | Cyrus |

(Continued)

FOREIGN PATENT DOCUMENTS

| | | | |
|---|---|---|---|
| JP | 2008012014 | A | 1/2008 |
| JP | 2011172830 | A | 9/2011 |

(Continued)

OTHER PUBLICATIONS

PCT Search Report and Written Opinion prepared for PCT/US2019/016292, completed Mar. 20, 2019.

*Primary Examiner* — Hanh V Tran

(74) *Attorney, Agent, or Firm* — WOMBLE BOND DICKINSON (US) LLP

(57) ABSTRACT

An apparatus and method for storing medical products such as pharmaceutical and medical products in climate controlled storage devices includes an enclosure and a plurality of storage drawers contained within the enclosure. The enclosure includes a plurality of walls and a storage-drawer support. The plurality of storage drawers are supported in the enclosure by the storage-drawer support.

20 Claims, 5 Drawing Sheets

(56) References Cited

U.S. PATENT DOCUMENTS

| | | | |
|---|---|---|---|
| 3,097,901 | A | 7/1963 | Schless |
| 3,241,902 | A | 3/1966 | Hamilton et al. |
| 3,261,585 | A | 7/1966 | Costantini |
| 3,782,800 | A | 1/1974 | Remington et al. |
| 3,826,552 | A | 7/1974 | Anderson |
| 4,239,306 | A | 12/1980 | Klaus |
| 4,453,790 | A | 6/1984 | Cohen et al. |
| 4,834,555 | A | 5/1989 | Grass |
| 5,123,721 | A | 6/1992 | Seo |
| 5,211,461 | A | 5/1993 | Teufel |
| 5,262,923 | A | 11/1993 | Batta et al. |
| 5,806,949 | A | 9/1998 | Johnson |
| 6,299,266 | B1 | 10/2001 | Justice |
| 6,312,186 | B1 | 11/2001 | Rock |
| 6,412,891 | B1 | 7/2002 | Liang et al. |
| 7,344,209 | B1 | 3/2008 | Miyashiro |
| 8,960,822 | B1 | 2/2015 | Hsu |
| 8,971,036 | B1 | 3/2015 | Lau |
| 9,363,921 | B1 | 6/2016 | Chen |
| 9,386,847 | B1 | 7/2016 | Jeffries |
| 9,468,128 | B2 | 10/2016 | Cheng et al. |
| 9,717,335 | B2 | 8/2017 | Zhang |
| 10,285,501 | B2 | 5/2019 | Hamon |
| 10,299,586 | B1 | 5/2019 | Powwarynn |
| 10,327,547 | B1 | 6/2019 | Shih et al. |
| 10,524,587 | B2 | 1/2020 | Rosner et al. |
| 2003/0075006 | A1 | 4/2003 | Coffin et al. |
| 2003/0205955 | A1 | 11/2003 | Egger |
| 2007/0252496 | A1 | 11/2007 | Remondino |
| 2008/0093320 | A1 | 4/2008 | Glover |
| 2012/0017414 | A1 | 1/2012 | Cemiglia |
| 2013/0169137 | A1 | 7/2013 | Susnjara |
| 2013/0278124 | A1 | 10/2013 | Hu |
| 2015/0022071 | A1 | 1/2015 | Chen |
| 2015/0048732 | A1 | 2/2015 | Gutierrez et al. |
| 2015/0098186 | A1 | 4/2015 | Aishinnawi |
| 2015/0163953 | A1 | 6/2015 | Chapel |
| 2015/0230605 | A1 | 8/2015 | Miyake |
| 2015/0327676 | A1 | 11/2015 | Chang |
| 2016/0174707 | A1 | 6/2016 | Chan et al. |
| 2016/0264368 | A1 | 9/2016 | Sugishima |
| 2016/0286958 | A1 | 10/2016 | Cinello et al. |
| 2019/0124783 | A1 | 4/2019 | Chapel |

FOREIGN PATENT DOCUMENTS

| | | | |
|---|---|---|---|
| JP | 2017193437 | A | 10/2017 |
| KR | 2013/0033013 | A | 4/2013 |
| WO | WO2005070257 | A1 | 8/2005 |
| WO | 2015140433 | A1 | 9/2015 |

STORAGE DEVICE WITH DRAWER RETAINER AND STABILIZER

CROSS-REFERENCE TO RELATED APPLICATIONS

This application is a continuation of U.S. Non-Provisional application Ser. No. 17/859,640, filed Jul. 7, 2022, which is a division of U.S. Non-Provisional application Ser. No. 16/967,002 (now U.S. Pat. No. 11,439,232) filed Aug. 3, 2020, which is a U.S. national stage entry under of, and claims priority to PCT/US2019/016292, filed Feb. 1, 2019, which further claims priority to U.S. Provisional Application Ser. No. 62/625,546, filed Feb. 2, 2018, the entirety of each being incorporated herein by reference.

TECHNICAL FIELD

The present disclosure is related to a storage device. More specifically, the present disclosure is related to a storage device with a plurality of drawers.

BACKGROUND

Medical supplies such as pharmaceuticals and blood products are a high value commodity requiring stringent quality and inventory control measures. Medical products including medications, tissues, and blood products such as whole blood, plasma, or platelets, for example, are in limited supply and have a limited shelf life and stringent quality control requirements to maintain the quality of the products. It is desirable to store these medical products in devices that are ergonomic and customizable for the product they are storing.

SUMMARY

The present application discloses one or more of the features recited in the appended claims and/or the following features which, alone or in any combination, may comprise patentable subject matter:

According to one aspect of the present disclosure, a storage device comprises an enclosure, a storage drawer, and a drawer retainer. The enclosure includes a plurality of walls that cooperate to define an internal space within the enclosure and a storage-drawer support coupled to at least one wall in the internal space. The storage drawer is movable relative to the storage-drawer support along a path within the internal space from a closed position to an opened position, the storage drawer contained within the internal space in the closed position and the storage drawer having a portion located in the internal space and a portion located outside the internal space in the opened position. The drawer retainer is removably coupled to the enclosure outside of the internal space and configured to change from a locked configuration to an unlocked configuration. The drawer retainer is further configured to extend into the internal space and engage the storage drawer in the locked configuration to block movement of the storage drawer further away from the enclosure when the storage drawer is in the opened position and configured to disengage selectively from the enclosure so that the storage drawer is movable to disengage from the storage-drawer support when the retainer is in the unlocked configuration.

According to another aspect of the present disclosure, a storage device comprises an enclosure, a storage drawer, and a drawer stabilizer. The enclosure includes a plurality of walls that cooperate to define an internal space within the enclosure and a storage-drawer support coupled to at least one wall in the internal space. The storage drawer is movable relative to the storage-drawer support along a path within the internal space from a closed position to an opened position, the storage drawer contained within the internal space in the closed position and the storage drawer having a portion located in the internal space and a portion located outside the internal space in the opened position. The drawer stabilizer is coupled to the enclosure between a wall and the storage drawer support, the drawer stabilizer configured to provide an inward force on the storage drawer to minimize lateral movement of the storage drawer relative to the enclosure.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
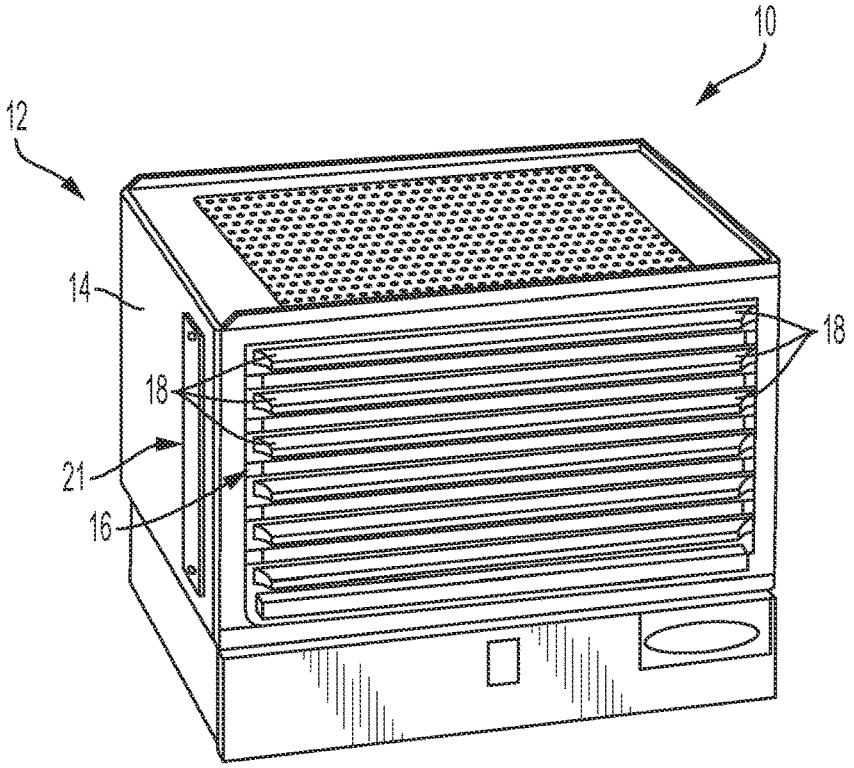
FIG. 1 is a perspective view of a storage unit illustratively embodied as an agitator having an enclosure and a plurality of storage drawers within the enclosure.
Figure 3:
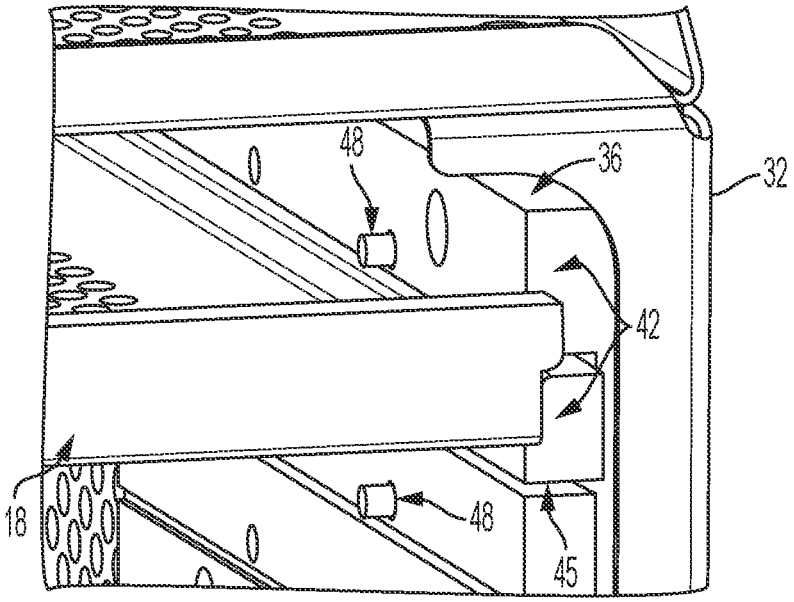
FIG. 3 is an enlarged perspective view of a storage drawer supported in the enclosure in a closed position.
Figure 4:
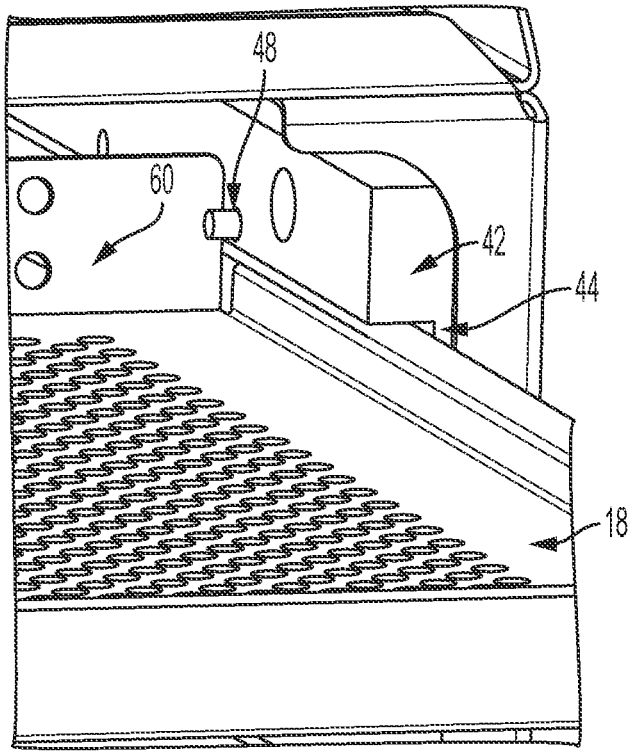
FIG. 4 is an enlarged perspective view of the storage drawer supported in the enclosure in an opened position and retained in the opened position by a retainer.

A storage device 10 illustratively embodied as a platelet agitator 12 as shown in FIG. 1. An example of an agitator is shown and described in U.S. Pat. No. 7,638,100 which is incorporated herein in its entirety. The storage device 10 includes an enclosure 14 forming an internal space 16 and a number of storage drawers 18 positioned in the internal space 16. Each storage drawer 18 is movable relative to the storage drawer support along a path defined by the storage support. The storage drawers 18 travel along the path from a closed position as shown in FIG. 3 to an opened position as shown in FIG. 4. The storage drawers 18 are contained within the enclosure 14 in the closed position. The storage drawers slide outwardly from the enclosure so that a portion of the drawers 18 remain within the enclosure and a portion of the drawers 18 is arranged outside of the enclosure for access to contents in the storage drawers 18. It should be understood that the enclosure 10 is positioned internal to the enclosure 14 and is movable relative to the enclosure 14 as discussed in the U.S. Pat. No. 7,638,100 to agitate bags of platelets stored on the storage drawers 18. As such, the agitation tends to cause some vibration and movement of the drawers 18 relative to the enclosure 14 in prior platelet agitator systems. This vibration may be sustained while the drawers 18 are opened to access material stored on the drawers 18. Thus, there is a need to support the drawers 18 during vibration and to provide stabilization of the drawers 18. As described below, the present disclosure is directed to providing stabilization for the drawers 18 in use.

The enclosure 14 is rectangular and includes a plurality of walls 20 that define the internal space 16 and a storage drawer support 22 coupled to the enclosure 14 within the internal space 16. Illustratively the plurality of walls 20 define the rectangular shape of the enclosure 14 and includes a ceiling 24, a floor 26, and first, second, and third side walls 28, 30, 32 that extend from the ceiling 24 to the floor 26. The enclosure 14 may further include a door (not shown) that may be opened to allow access to the internal space 16 and closed to block access to the internal space 16. The storage drawer support 22 is coupled to the first and third side walls 28, 32 and extends from the ceiling 24 to the floor 26 to support the storage drawers 18 on top of one another in the internal space 16.

Figure 2:
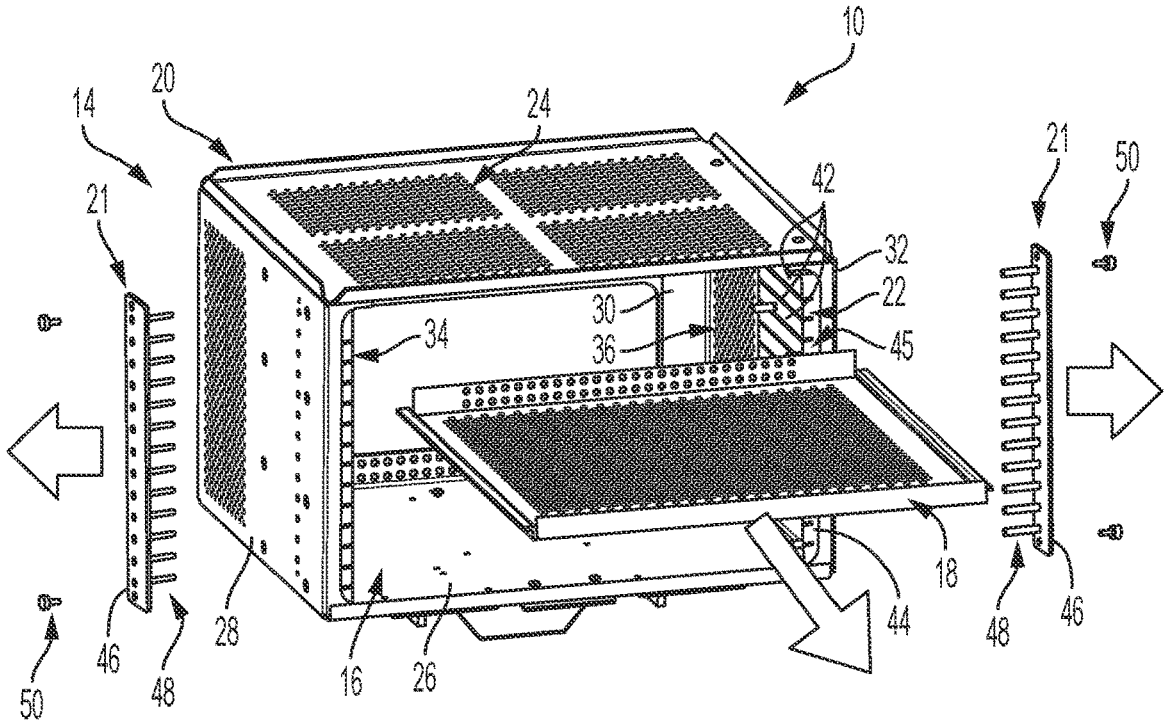
FIG. 2 is a partial exploded assembly and diagrammatic view of the storage unit with the storage drawers removed from the enclosure.

The storage drawer support 22 includes a left support unit 34 and a right support unit 36 as shown in FIG. 2. The left support unit 34 is coupled to the first wall 28 and is configured to support a left side 38 of each storage drawer 18. The right support unit 36 is coupled to the third side wall 32 and is configured to support a right side 40 of each storage drawer 18.

Each support unit 34, 36 includes a plurality of support beams 42 and a plate 44. The plurality of support beams 42 are spaced apart from one another and are stacked from the floor 26 to the ceiling 24. Gaps 45 are provided between adjacent support beams 42 included in the plurality of support beams 42 to receive the left and right sides 38, 40 of the storage drawers 18. The plate 44 is coupled to the plurality of support beams 42 between a respective side wall 28, 32 of the enclosure 14 and the plurality of support beams 42.

Figure 8:
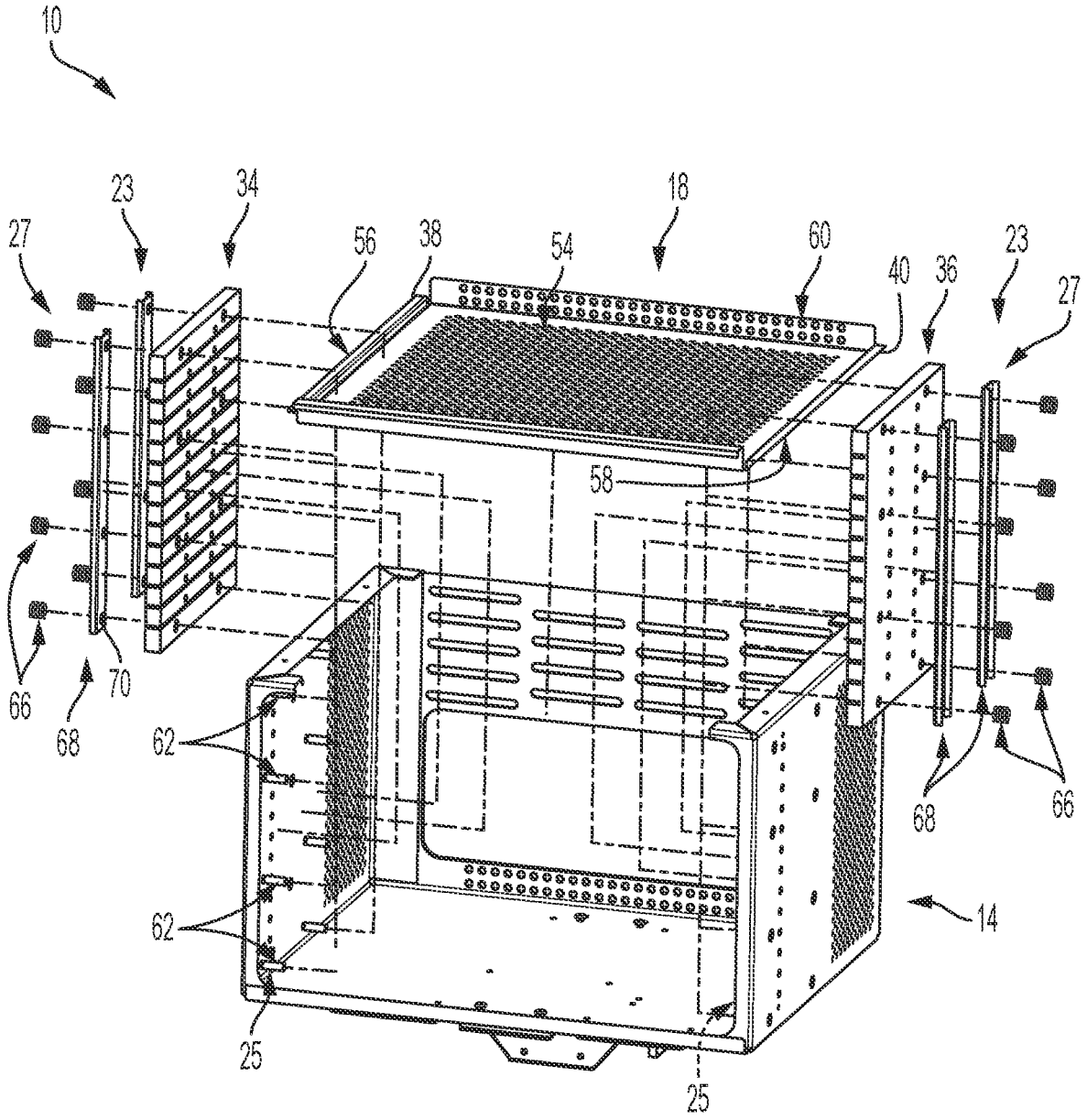
FIG. 8 is an exploded assembly view of the storage device showing a pair of drawer stabilizers.

The storage device 10 further includes a pair of drawer retainers 21 coupled to an exterior of the enclosure 14 as shown in FIG. 2 and a pair of drawer stabilizers 23 as shown in FIG. 8. The drawer retainers 21 are arranged to extend from the exterior of the enclosure 14 and protrude into the internal space 16 as shown in FIGS. 3 and 4. The drawer retainers 21 engage the storage drawers 18 in the opened position to block movement of the storage drawers 18 further away from the enclosure 14 as shown in FIG. 4. The drawer stabilizers 23 are configured to apply inward forces on the storage drawers 18 to block lateral movement of the storage drawers 18 in the internal space 16.

Each drawer retainer 21 is removably coupled to the enclosure 14 outside of the internal space 16 and may be changed from a locked configuration as shown in FIG. 1 to an unlocked configuration as shown in FIG. 2. The drawer retainers 21 are fastened to the enclosure 14 in the locked configuration and are unfastened and disengaged from the enclosure 14 in the unlocked configuration. All of the storage drawers 18 are removable selectively from the internal space 16 when the drawer retainers 21 are in the unlocked configuration to raise or lower each storage drawer 18 within the internal space 16 as shown in FIG. 2. Similarly, all of the storage drawers 18 are blocked from further movement away from the enclosure 14 when the drawer retainers 21 are in the locked configuration.

Figure 9:
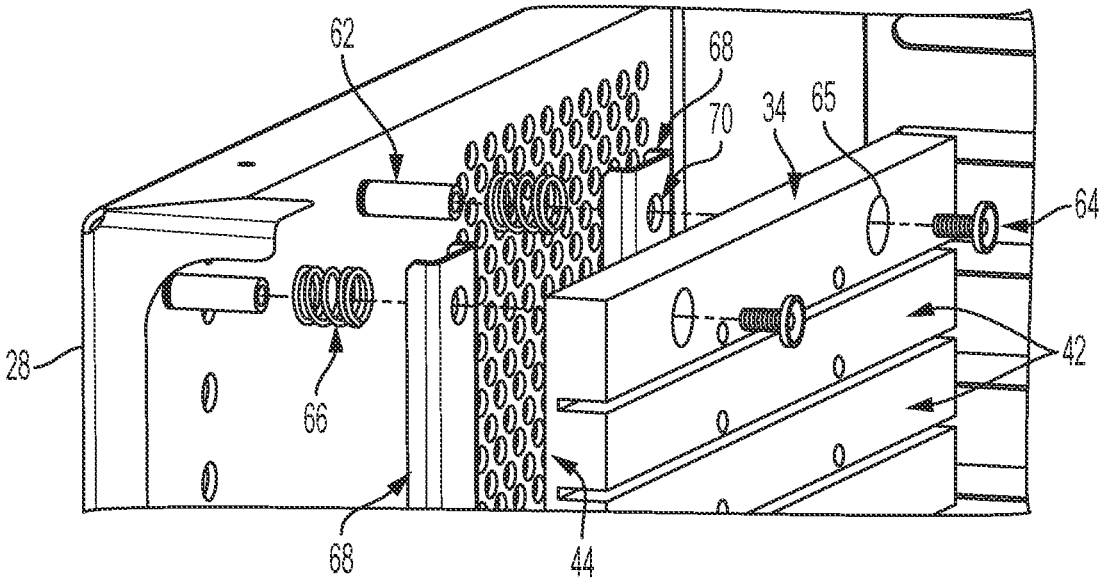
FIG. 9 is a perspective and partial exploded assembly view of the storage device and a drawer stabilizer.
Figure 10:
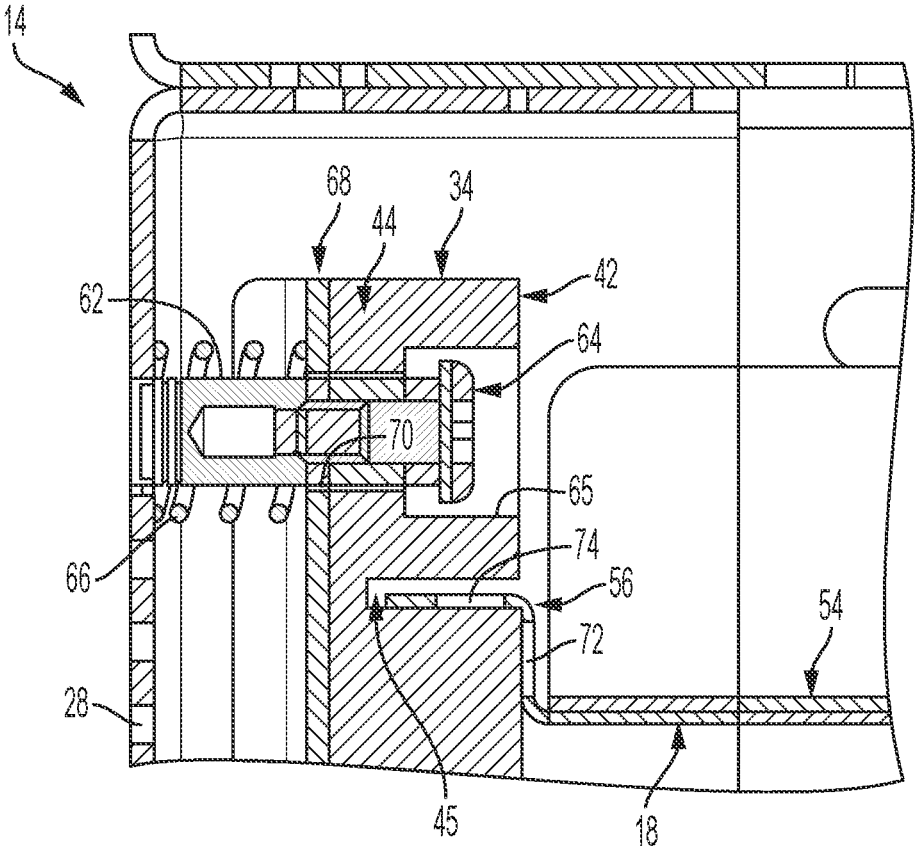
FIG. 10 is a sectional view of the storage device and the drawer stabilizer.

The drawer stabilizers 23 bias the support units 34, 36 inwardly to minimize a distance between the support units 34, 36 and the left and right sides 38, 40 of the storage drawers 18. Each drawer stabilizer 23 includes a mount system 25 and a bias system 27 as shown in FIGS. 8-10. Each mount system 25 couples a respective support unit 34, 36 to the enclosure and allows lateral movement of the support units 34, 36 relative to the enclosure 14. Each bias system 27 is configured to bias a respective support unit 34, 36 inwardly toward the internal space 16 such that the support units are spaced apart from the enclosure 14.

In the illustrative embodiment, a pair of drawer retainers 21 is included in the storage device 10. However, only one drawer retainer 21 may be included in the storage device. In another example, any suitable number of drawer retainers 21 may be used.

Each drawer retainer 21 includes a back plate 46, a plurality of retainer posts 48, and fasteners 50 as shown in FIGS. 2 and 5-7. The back plate 46 is arranged to lie on the exterior of the enclosure when the drawer retainer 21 is in the locked configuration. The plurality of retainer posts 48 are arranged to extend from the back plate 46 and through the enclosure 14 and the support units 34, 36. The plurality of posts 48 protrude into the internal space 16 where they engage the storage drawers 18 in the opened position to block further movement of the storage drawers 18 away from the enclosure 14. The fasteners 50 secure each drawer retainer 21 to the enclosure 14.

The back plate 46 is arranged to extend from the ceiling 24 of the enclosure 14 to the floor 26 of the enclosure 14 as shown in FIG. 2. The retainer posts 48 are aligned vertically on the back plate 46 and are spaced apart equal distances from the ceiling 24 of the enclosure 14 to the floor 26 of the enclosure 14. However, any suitable arrangement and spacing of the retainer posts 48 on the back plate 46 may be used.

Illustratively, each drawer retainer 21 includes thirteen retainer posts 48. Each of the retainer posts 48 may engage a respective storage drawer 18. However, any suitable number of retainer posts 48 may be used depending on the number of drawers 18 included in the storage device 10. Additionally, the storage device 10 may include a number of storage drawers 18 that is less than a number of retainer posts 48.

The fasteners 50 in the illustrative embodiment include thumbscrews that may be manually twisted to fasten or remove the fasteners 50 from the enclosure 14. However, in other embodiments any suitable fastener may be used to secure the drawer retainers 21 to the exterior of the enclosure 14. Additionally, any suitable method of fastening may be used such as, for example, mechanical fastening, magnetic fastening, adhesive fastening, hook and loop structures, or key and slot structures. In another example, the back plate 46 is coupled permanently to the exterior of the enclosure 14 and the retainer posts 48 are removeably coupled to the back plate 46 or the enclosure 14 using any of the methods or structures described above.

Figure 5:
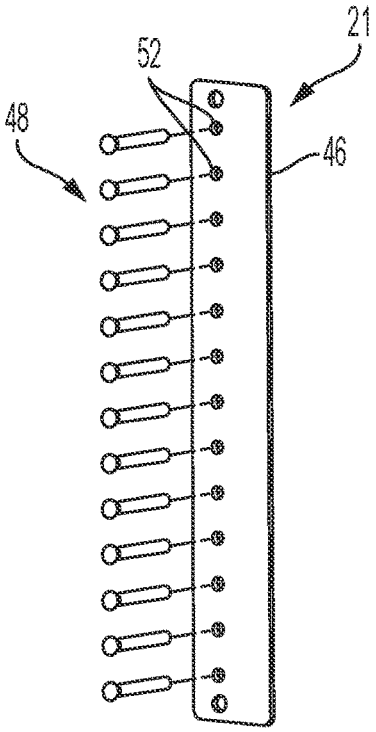
FIG. 5 is an exploded assembly view of the retainer.
Figure 6:
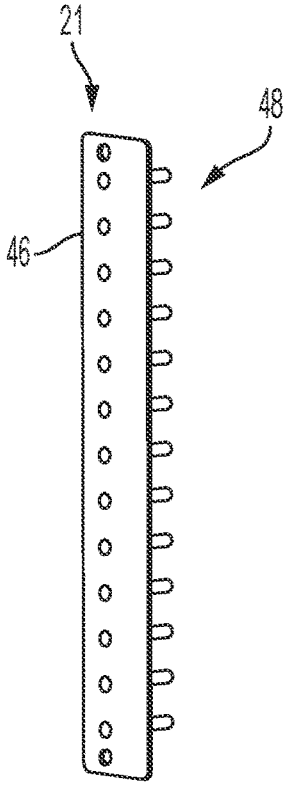
FIG. 6 is a perspective view of the retainer.
Figure 7:
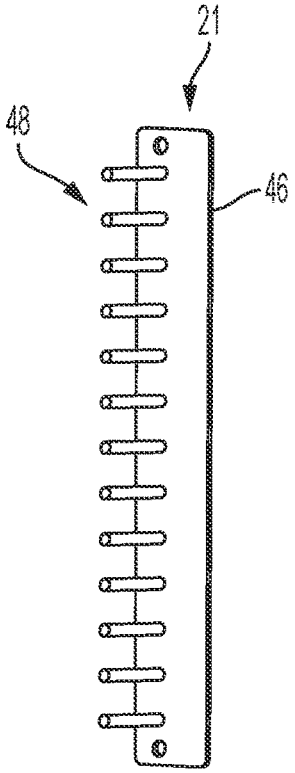
FIG. 7 is another perspective view of the retainer

The retainer posts 48 in the illustrative embodiment are arranged to extend through respective post apertures 52 formed in the back plate 46 as shown in FIG. 5. The retainer posts 46 may be coupled to the back plate 46 using any suitable method such as, for example, by press fitting each retainer post 48 to the back plate 46 or by spot or capacitive welding each retainer post 48 to the back plate 46.

In the illustrative embodiment, a pair of drawer stabilizers 23 is included in the storage device 10 as shown in FIG. 8. However, only one drawer stabilizer 23 may be included in the storage device 10. In another example, any suitable number of drawer stabilizers 23 may be used.

The mount system 25 and the bias system 27 of a drawer stabilizer 23 are described below and shown in FIGS. 9 and 10. Although one drawer stabilizer 23 is described in relation to support unit 34, right support unit 36 is similar to left support unit 34. As such, right support unit 36 cooperates with a respective drawer stabilizer similarly to the relationship described below relating to left support unit 34.

The mount system 25 of each drawer stabilizer 23 includes a mount post 62 and a fastener 64 as shown in FIGS. 9 and 10. The mount post 62 is coupled to a side wall of the enclosure 14 and extends inwardly into the internal space 16. The mount post 62 is received in a mount post aperture 65 formed in the support unit 34 and blocks upward and downward movement of the support unit 34 relative to the mount post 62 and the enclosure 14. The fastener 64 is received in the mount post 62 and is spaced apart from the support unit 34 to allow lateral movement of the support unit 34 relative to the mount post 62.

The biasing system 27 includes a biasing spring 66 and a support flange 68 as shown in FIGS. 8-10. The biasing spring 66 extends between a side wall of the enclosure to the support flange 68 and provides the inward force on the support unit 34. The biasing spring 66 may be a coil spring, a leaf spring, a wire spring, or any other suitable device capable of providing the inward force on the support unit 34. The support flange 68 is formed to include a mount post aperture 70 that is arranged to receive the mount post 62. The biasing system 27 is configured to bias the support flange 68 toward the support unit 34 so that the support flange 68 and the support unit 34 are spaced apart from the side wall of the enclosure 14. In other embodiments, the biasing system may not include a support flange 68 and the biasing system 27 is configured to provide the inward force directly to the support unit 34.

In the illustrative embodiment, each mount system 25 includes two columns of mount posts 62 coupled to respective side walls of the enclosure 14 as shown in FIG. 8. In other embodiments, any suitable number of columns may be used. In the illustrative embodiment, each column of mount posts 62 includes four mount posts aligned vertically from the ceiling 24 to the floor 26. In other embodiments, any suitable number of mount posts may be included in each column. In some embodiments, the mount posts 62 of each column may be spaced apart from one another equal distances along the side wall. In other embodiments, any suitable spacing of the mount posts may be used.

In the illustrative embodiment, a support flange 68 is provided for each column of mount posts. In other embodiments, any suitable number of support flanges may be used. In other embodiments, the support flanges may be arranged along rows of mount posts. In the illustrative embodiment, each support flange 68 includes a plurality of mount post apertures 70 to complement the number of mount posts 62 included in each column. In other embodiments, any suitable number of apertures 70 may be used.

Each storage drawer 18 includes a basin 54, first and second side rails 56, 58, and a drawer stop 60 as shown in FIG. 8. The basin 54 is arranged to extend from the left support unit 34 to the right support unit 36. The left side rail 56 is arranged on the left side 38 of each storage drawer 18 and is received within a gap 45 between adjacent support beams included in the plurality of support beams 42 of the left support unit 34. The right side rail 58 is arranged on the right side 40 of each storage drawer 18 and is received within a gap 45 between adjacent support beams included in the plurality of support beams 42 of the right support unit 36. The drawer stop 60 is configured to engage a retainer post 48 when the storage drawer 18 is in the opened position.

The drawer stop 60 extends upwardly from the basin 54 as shown in FIG. 4. In the illustrative embodiment, the drawer stop 60 is formed as an extension of the basin and is bent upwardly so that the drawer stop 60 interferes with a retainer post 48 to block movement of the drawer 18 further away from the enclosure 14 in the opened position.

The left side rail 56 includes an upwardly extending flange 72 and an outwardly extending flange 74 as shown in FIG. 10. The upwardly extending flange 72 is coupled to the basin 54. The outwardly extending flange 74 is coupled to the upwardly extending flange 72 and is received within a gap 45 provided between adjacent support beams 42 included in the left support unit 34. The inward force provided by the biasing spring 66 is transferred from the support unit 34 to the upwardly extending flange 72. As such, a distance between support unit 34 and the storage drawer 18 is minimized or eliminated.

The right side rail 58 is similar to the left side rail 56 and cooperates with the right support unit 36 similarly to the relationship between the left side rail 56 and the left support unit 34. As such, although only left side rail 56 is shown in FIGS. 9 and 10, right side rail 58 is similar to left side rail 56. As such, right ride rail 58 cooperates with a respective support unit 36 similarly to the relationship described above relating to left side rail 56 and respective support unit 34.

Although certain illustrative embodiments have been described in detail above, variations and modifications exist within the scope and spirit of this disclosure as described and as defined in the following claims.

What is claimed is:

1. An agitator for agitating medical supplies, the agitator comprising:

an enclosure;

a storage-drawer support positioned in the enclosure such that the storage-drawer support is configured to float toward and away from a wall of the enclosure;

a storage drawer supported on the storage-drawer support in the enclosure; and a drawer stabilizer positioned between the wall and the storage-drawer support, the drawer stabilizer configured to bias the storage-drawer support away from the wall to exert a biasing force on and the storage drawer via the storage-drawer support, to thereby stabilize the storage drawer.

2. The agitator of claim 1, wherein the drawer stabilizer includes a mount post extending away from the wall in the enclosure, and wherein the storage-drawer support is configured to float along the mount post.

3. The agitator of claim 2, wherein the drawer stabilizer includes a coiled spring positioned about the mount post, between the wall and the storage-drawer support.

4. The agitator of claim 1, wherein the storage-drawer support includes a gap, and wherein an edge of the storage drawer is received in the gap.

5. The agitator of claim 4, wherein the edge of the storage drawer is slidable within the gap to extend and retract the storage drawer out from and into, respectively, the enclosure.

6. The agitator of claim 5, further comprising a retainer post that extends away from the wall in the enclosure and through the storage-drawer support to limit a slidable range of the storage drawer along the gap.

7. The agitator of claim 1, wherein the storage drawer comprises a first storage drawer, wherein the agitator further comprises a second storage drawer supported on the storage-drawer support and vertically spaced from the first storage drawer, and wherein the drawer stabilizer is configured to bias the storage-drawer support away from the wall to exert the biasing force on both the first storage drawer and the second storage drawer via the storage-drawer support to thereby stabilize the first storage drawer and the second storage drawer.

8. A storage device comprising:

an enclosure;

a plurality of storage drawers positioned in the enclosure;

a storage-drawer support including a plate that is configured to support the plurality of storage drawers in a vertical stack in the enclosure; and a drawer stabilizer positioned between the plate and a wall of the enclosure that is configured to exert a biasing force on the plurality of storage drawers via the plate.

9. The storage device of claim 8, wherein the drawer stabilizer includes a plurality of mount posts extending away from the wall in the enclosure, wherein the plate is slidable along the plurality of mount posts.

10. The storage device of claim 9, wherein the drawer stabilizer includes a plurality of coiled springs positioned about the plurality of mount posts, between the wall and the plate.

11. The storage device of claim 10, wherein each of the mount posts includes a flange at a terminal end thereof that is configured to limit a movement of the plate along the plurality of mount posts.

12. The storage device of claim 11, wherein the flange of each of the plurality of mount posts is defined by a fastener engaged with the terminal end.

13. The storage device of claim 8, further comprising a plurality of retainer posts extending away from the wall in the enclosure and through the plate to limit a slidable range of each of the plurality of storage drawers out of the enclosure.

14. A storage device comprising:

an enclosure;

a floating wall within the enclosure;

a plurality of storage drawers at least partially supported on the floating wall; and a drawer stabilizer that is configured to bias the floating wall toward the plurality of storage drawers within the enclosure to thereby exert a biasing force on the plurality of storage drawers.

15. The storage device of claim 14, wherein the drawer stabilizer includes a plurality of mount posts extending through the floating wall, wherein the floating wall is slidable along the plurality of mount posts.

16. The storage device of claim 15, wherein the drawer stabilizer includes a plurality of coiled springs positioned about the plurality of mount posts to bias the floating wall into engagement with the plurality of storage drawers.

17. The storage device of claim 16, wherein each of the mount posts includes a flange at a terminal end thereof that is configured to limit a movement of the floating wall along the plurality of mount posts.

18. The storage device of claim 14, wherein the floating wall includes a plurality of gaps, and wherein an edge of each of the plurality of storage drawers is inserted into a corresponding gap of the plurality of gaps.

19. The storage device of claim 18, wherein the edge of each of the plurality of storage drawers is slidable within the corresponding gap to extend and retract the plurality of storage drawers out from and into, respectively, the enclosure.

20. The storage device of claim 19, further comprising a plurality of retainer posts extending through the floating wall to limit a slidable range of the plurality of storage drawers along the plurality of gaps.

* * * * *